US011920883B1

(12) United States Patent
Anderson, Jr.

(10) Patent No.: US 11,920,883 B1
(45) Date of Patent: Mar. 5, 2024

(54) SUPPRESSOR ASSEMBLY FOR A FIREARM

(71) Applicant: Henry Anderson, Jr., Silver Spring, MD (US)

(72) Inventor: Henry Anderson, Jr., Silver Spring, MD (US)

( * ) Notice: Subject to any disclaimer, the term of this patent is extended or adjusted under 35 U.S.C. 154(b) by 0 days.

(21) Appl. No.: 18/131,988

(22) Filed: Apr. 7, 2023

Related U.S. Application Data

(60) Provisional application No. 63/377,163, filed on Sep. 26, 2022.

(51) Int. Cl.
*F41A 21/30* (2006.01)
*F41A 21/32* (2006.01)

(52) U.S. Cl.
CPC ..... *F41A 21/30* (2013.01); *F41A 21/325* (2013.01)

(58) Field of Classification Search
CPC ..... F41A 21/30; F41A 21/34; F41A 21/325; F41A 21/36; F41A 21/38
See application file for complete search history.

(56) References Cited

U.S. PATENT DOCUMENTS 916,885 A 3/1909 Maxim
1,140,578 A * 5/1915 Coulombe ..... F41A 21/30 181/223
1,173,687 A * 2/1916 Thompson ..... F41A 21/30 89/14.4
1,229,675 A * 6/1917 Thompson ..... F41A 21/30 89/14.3
2,337,840 A * 12/1943 Scott-Paine ..... F41A 13/12 89/14.1
2,916,970 A * 12/1959 Mutter ..... F41A 21/28 89/14.3
3,611,867 A * 10/1971 Silsby ..... F41A 21/28 42/105
3,677,132 A 7/1972 Plenge
5,136,923 A 8/1992 Walsh, Jr.
5,355,765 A * 10/1994 Rogers ..... F41A 21/24 89/14.4
5,412,895 A 5/1995 Krieger
6,490,822 B1 12/2002 Swan
6,694,660 B1 2/2004 Davies
7,523,580 B1 4/2009 Tankersley
7,789,008 B2 9/2010 Petersen
8,015,908 B2 * 9/2011 Kline ..... F41A 21/30 89/14.4
8,505,680 B2 8/2013 Dueck
8,567,556 B2 10/2013 Dueck
8,973,481 B2 3/2015 Dueck
(Continued)

*Primary Examiner* — Joshua E Freeman

(57) ABSTRACT

A suppressor assembly for a firearm having a receiver and a barrel connected to the receiver includes a tube adapted to be coupled to the receiver and defining at least one port arranged proximate to a first end. The tube encloses the barrel defining a radial gap therebetween. Moreover, the tube extends outwardly of the barrel in a longitudinal direction defining an axial gap therebetween. The radial gap and the axial gap together define an expansion volume around the barrel. An end cap is arranged at a second end of the tube and coupled to the tube. The end cap defines an outlet opening to facilitate an exit of a bullet from the tube. Propellant gases, generated during firing of the bullet, expand inside the expansion volume and exit the tube through the at least one port.

23 Claims, 7 Drawing Sheets

(56) References Cited

U.S. PATENT DOCUMENTS

| | | | | |
|---|---|---|---|---|
| 9,103,618 | B2 | 8/2015 | Daniel | |
| 9,803,946 | B2 | 10/2017 | Schoenlau | |
| 9,879,933 | B2 | 1/2018 | Myers | |
| 10,228,210 | B2 | 3/2019 | Parker | |
| 10,386,146 | B2 | 8/2019 | Spector | |
| 10,753,699 | B2 | 8/2020 | Klett | |
| 10,760,866 | B2 | 9/2020 | Facchini | |
| 11,054,207 | B2 * | 7/2021 | Martin | F41A 21/28 |
| 2011/0265365 | A1 * | 11/2011 | Alonso Tricio | F41A 21/02 42/78 |
| 2014/0190345 | A1 * | 7/2014 | Daniel | F41A 21/325 89/193 |
| 2015/0090105 | A1 * | 4/2015 | Pace | F41A 21/30 89/14.4 |
| 2017/0299291 | A1 * | 10/2017 | Spector | F41A 5/26 |
| 2018/0245871 | A1 * | 8/2018 | Göggel | F41A 21/36 |
| 2018/0274873 | A1 * | 9/2018 | Thomas | F41A 21/30 |
| 2019/0017768 | A1 * | 1/2019 | Thomas | F41A 21/30 |
| 2019/0017773 | A1 * | 1/2019 | Myers | F41A 21/30 |
| 2020/0256636 | A1 * | 8/2020 | Martini | F41A 35/02 |

* cited by examiner

SUPPRESSOR ASSEMBLY FOR A FIREARM

CROSS-REFERENCE TO RELATED PATENT APPLICATIONS

This application claims priority to and the benefit of U.S. Provisional Patent Application No. 63/377,163, filed on Sep. 26, 2022, the contents of which are hereby incorporated by reference herein for all purposes.

TECHNICAL FIELD

The present disclosure relates, generally, to a firearm. More particularly, the present disclosure pertains to a suppressor assembly for the firearm for reducing noise generated during firing a bullet.

BACKGROUND INFORMATION

Noise is generated when a bullet leaves a barrel of a firearm as the propulsive gases are released to atmosphere. Another source of noise from the suppressors is the interaction of the pressure waves, from the pressurized propellant gas that exits the rifle barrel when the bullet uncorks the bore of the barrel, that impinge upon the internal structure or tube of the suppressor. Pressure waves will cause this tube to radially deflect and vibrate. Noise will be radiated from this structure or tube if it is in direct contact with the atmosphere.

Reduction of said noise is generally accomplished through the use of a suppressor mounted onto the firearm. The method of suppressor operation is to contain the gases that exit the muzzle of the firearm within a closed vessel with an opening for the bullet and may have one or more additional ports for the propellant gases, allow the gases to expand, and then release them to atmosphere. This process reduces the sound pressure level in dB (Decibels) of the firearm when fired. These suppressors come in various internal and external component arrangements, generally attaching to the muzzle, or may attach to the gas block, or may attach in some other manner to the firearm. Suppressors are generally fabricated from a high strength material to withstand propellant gas pressure and temperature. Providing a large suppressor internal volume will result in lower pressures inside the suppressor and therefore allow the use of lower strength and less costly materials such as aluminum and non-metallics. Lower pressures inside the suppressor will also decrease the noise emitted when the firearm is fired. The diameter of the opening in the suppressor for the bullet exit also affects the noise emitted; larger opening diameters resulting in greater noise. The co-linearity between axes of the suppressor and the barrel of the firearm controls the diameter of this bullet opening; i.e., with perfect co-linearity the bullet opening diameter could be the same as the diameter of the bullet. The greater the divergence between these axes, the larger the diameter required for the bullet opening to achieve un-impeded bullet exit. Co-linearity issues become more pronounced for longer suppressors. The embodiments of this disclosure address the aforementioned.

SUMMARY OF DISCLOSURE

One aspect of this disclosure relates to a suppressor assembly for a firearm is disclosed. The firearm includes a receiver and a barrel connected to the receiver. The suppressor assembly includes a tube having a first end adapted to be coupled to the receiver and defining at least one port arranged proximate to the first end and extending in a radial direction. The tube is configured to be arranged around the barrel defining a radial gap therebetween. Moreover, the tube is configured to extend outwardly of the barrel in a longitudinal direction defining an axial gap therebetween. The radial gap and the axial gap together define an expansion volume around the barrel. The suppressor assembly further includes an end cap arranged at a second end of the tube and coupled to the tube. The end cap defines an outlet opening adapted to be arranged coaxially to the barrel to facilitate an exit of a bullet from the tube. Propellant gases generated, during firing of the bullet, expand inside the expansion volume and exit the tube through the at least one port.

In some additional, alternative, or selectively cumulative embodiments, the suppressor assembly further includes an adapter configured to couple the first end of the tube to the receiver.

In some additional, alternative, or selectively cumulative embodiments, the adapter includes a body portion adapted to be arranged between the receiver and the tube in a radial direction and configured to couple the receiver to the tube. The adapter further includes a flange portion extending radially outwardly of the body portion and adapted to be arranged between the receiver and tube to limit engagement of the tube.

In some additional, alternative, or selectively cumulative embodiments, the tube is an inner tube and the suppressor assembly further includes an outer tube configured to be arranged around the inner tube and defining an annular volume therebetween to receive the propellant gases from the expansion volume exiting the at least one port of the inner tube.

In some additional, alternative, or selectively cumulative embodiments, the outer tube includes at least one outlet arranged proximate to an end of the outer tube and extending in a radial direction. The at least one outlet facilitates an escape of the propellant gases from the annular volume.

In some additional, alternative, or selectively cumulative embodiments, the suppressor assembly includes at least one end plug disposed between the inner tube and the outer tube and engaged with the inner tube and the outer tube.

In some additional, alternative, or selectively cumulative embodiments, the suppressor assembly includes at least one stopper structure arranged between the inner tube and the outer tube to restrict a movement of the at least one end plug in the longitudinal direction.

In some additional, alternative, or selectively cumulative embodiments, the at least one end plug is arranged proximate to the second end of the inner tube. The at least one end plug defines a plurality of exit ports arrayed circularly around a central axis of the at least one end plug and extending in the longitudinal direction.

In some additional, alternative, or selectively cumulative embodiments, the suppressor assembly includes a damping layer arranged abutting an outer surface of the outer tube. The damping layer includes a sound absorbing material to reduce noise emanation from the outer surface of the outer tube.

In accordance with another example embodiment, a firearm is disclosed. The firearm includes a receiver and a barrel coupled to the receiver. The firearm further includes a tube having a first end coupled to the receiver and defining at least one port arranged proximate to the first end and extending in a radial direction. The tube is configured to be arranged around the barrel defining a radial gap therebetween. Further, the tube extends outwardly of the barrel in a longitudinal direction defining an axial gap therebetween.

The radial gap and the axial gap together define an expansion volume around the barrel. The firearm further includes an end cap arranged at a second end of the tube and coupled to the tube. The end cap defines an outlet opening arranged coaxially to the barrel to facilitate an exit of a bullet from the tube. Propellant gases, generated during firing of the bullet, expand inside the expansion volume and exit the tube through the at least one port.

In some additional, alternative, or selectively cumulative embodiments, the firearm further includes an adapter coupling the first end of the tube to the receiver. The adapter includes a body portion arranged between the receiver and the tube in a radial direction and coupling the receiver to the tube. The adapter further includes a flange portion extending radially outwardly of the body portion and adapted to be arranged between the receiver and tube in the longitudinal direction to limit engagement of the tube.

In some additional, alternative, or selectively cumulative embodiments, the tube is an inner tube and the firearm further includes an outer tube configured to be arranged around the inner tube defining an annular volume therebetween to receive the propellant gases from the expansion volume exiting the at least one port defined at the inner tube.

In some additional, alternative, or selectively cumulative embodiments, the outer tube includes at least one outlet arranged proximate to an end of the outer tube and extending in the radial direction. The at least one outlet facilitates an escape of the propellant gases from the annular volume.

In some additional, alternative, or selectively cumulative embodiments, the firearm further includes at least one end plug disposed between the inner tube and the outer tube and engaged with the inner tube and the outer tube.

In some additional, alternative, or selectively cumulative embodiments, the firearm also includes at least one stopper structure arranged between the inner tube and the outer tube to restrict a movement of the at least one end plug in the longitudinal direction.

In some additional, alternative, or selectively cumulative embodiments, the at least one end plug is arranged proximate to the second end of the inner tube and defines a plurality of exit ports arrayed circularly around a central axis of the first end plug and extending in the longitudinal direction.

In accordance with another example embodiment, a suppressor assembly for a firearm having a receiver and a barrel connected to the receiver is disclosed. The suppressor assembly includes a first tube having a first end coupled to the receiver and defining at least one port arranged proximate to the first end and extending in a radial direction. The first tube is configured to be arranged around the barrel defining a radial gap therebetween. The first tube is further configured to extend outwardly of the barrel in a longitudinal direction defining an axial gap therebetween. The radial gap and the axial gap together define an expansion volume around the barrel. The suppressor assembly further includes an end cap arranged at a second end of the first tube and coupled to the first tube. The end cap defines an outlet opening adapted to be arranged coaxially to the barrel to facilitate an exit of a bullet from the first tube. The suppressor assembly further includes a second tube configured to be arranged around the first tube and defining an annular volume therebetween and at least one end plug disposed between the first tube and the second tube and engaged with the first tube and the second tube. The at least one of the second tube defines at least one outlet extending in the radial direction, or the at least one end plug defines a plurality of exit ports arrayed circularly around a central axis of the end plug and extending in the longitudinal direction. Propellant gases generated, during firing of the bullet, expand inside the expansion volume and enter the annular volume from the expansion volume through the at least one port.

In some additional, alternative, or selectively cumulative embodiments, the suppressor assembly further includes an adapter configured to couple the first end of the tube to the receiver. The adapter includes a body portion adapted to be arranged between the receiver and the tube in the radial direction and configured to couple the receiver to the tube. The adapter further includes a flange portion extending radially outwardly of the body portion and adapted to be arranged between the receiver and tube to limit engagement of the tube.

In some additional, alternative, or selectively cumulative embodiments, the suppressor assembly further includes at least one stopper structure arranged between the inner tube and the outer tube to restrict a movement of the at least one end plug in the longitudinal direction.

Additional aspects and advantages will be apparent from the following detailed description of example embodiments, which proceeds with reference to the accompanying drawings.

DETAILED DESCRIPTION

Figure 1:
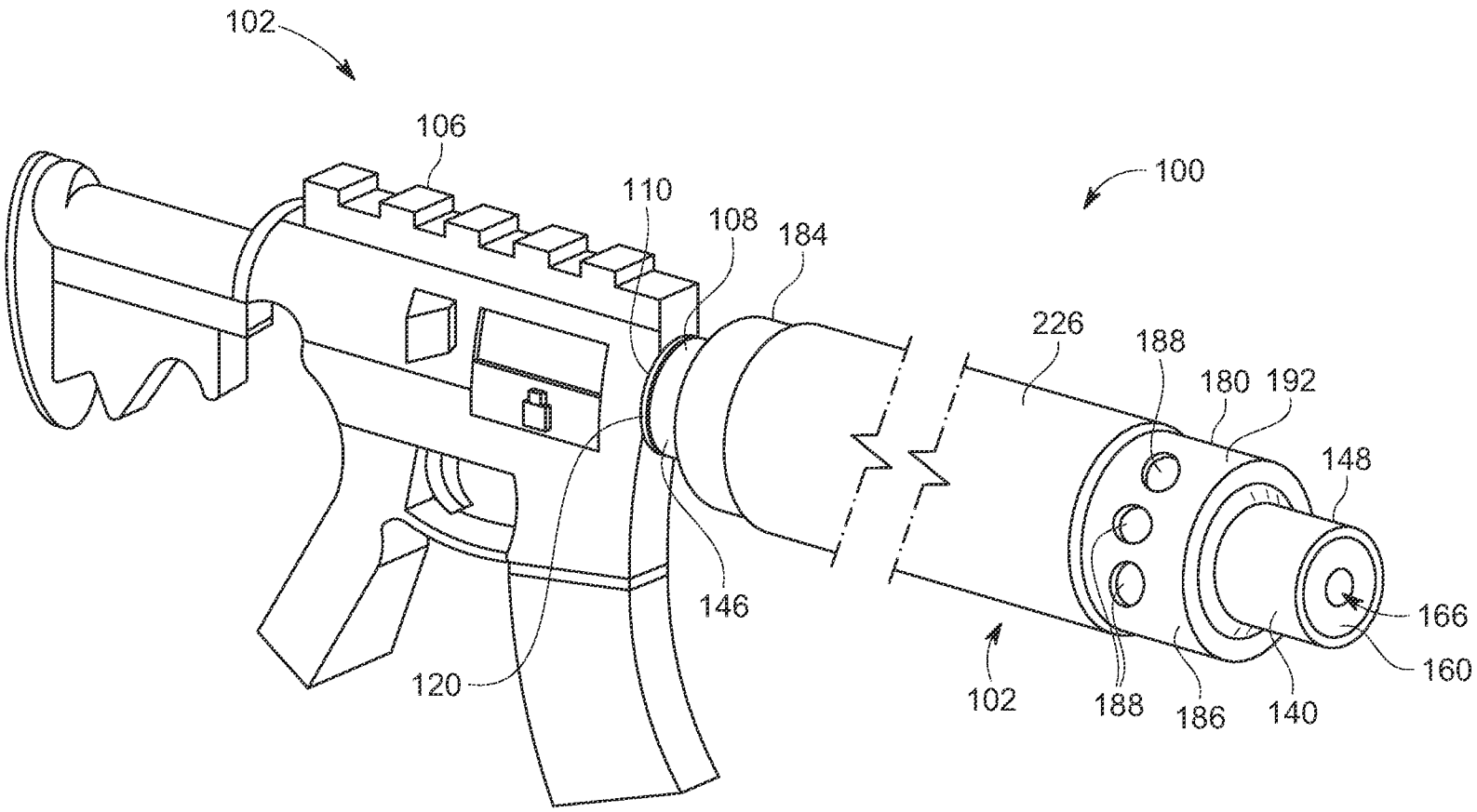
FIG. 1 illustrates a perspective view of an example firearm having a suppressor assembly, in accordance with an embodiment of the disclosure.

Example embodiments are described below with reference to the accompanying drawings. Unless otherwise expressly stated in the drawings, the sizes, positions, etc., of components, features, elements, etc., as well as any distances therebetween, are not necessarily to scale, and may be disproportionate and/or exaggerated for clarity.

The terminology used herein is for the purpose of describing particular example embodiments only and is not intended to be limiting. As used herein, the singular forms "a," "an" and "the" are intended to include the plural forms as well, unless the context clearly indicates otherwise. It should be recognized that the terms "comprise," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. Unless otherwise specified, a range of values, when recited, includes both the upper and lower limits of the range, as well as any sub-ranges therebetween. Unless indicated otherwise, terms such as "first," "second," etc., are only used to distinguish one element from another. For example, one element could be termed a "first element" and similarly, another element could be termed a "second element," or vice versa. The section headings used herein are for organizational purposes only and are not to be construed as limiting the subject matter described.

Unless indicated otherwise, the terms "about," "thereabout," "substantially," etc. mean that amounts, sizes, formulations, parameters, and other quantities and characteristics are not and need not be exact, but may be approximate and/or larger or smaller, as desired, reflecting tolerances, conversion factors, rounding off, measurement error and the like, and other factors known to those of skill in the art.

Spatially relative terms, such as "right," left," "below," "beneath," "lower," "above," and "upper," and the like, may be used herein for ease of description to describe one element's or feature's relationship to another element or feature, as illustrated in the drawings. It should be recognized that the spatially relative terms are intended to encompass different orientations in addition to the orientation depicted in the figures. For example, if an object in the figures is turned over, elements described as "below" or "beneath" other elements or features would then be oriented "above" the other elements or features. Thus, the term "below" can, for example, encompass both an orientation of above and below. An object may be otherwise oriented (e.g., rotated 90 degrees or at other orientations) and the spatially relative descriptors used herein may be interpreted accordingly.

Unless clearly indicated otherwise, all connections and all operative connections may be direct or indirect. Similarly, unless clearly indicated otherwise, all connections and all operative connections may be rigid or non-rigid.

Like numbers refer to like elements throughout. Thus, the same or similar numbers may be described with reference to other drawings even if they are neither mentioned nor described in the corresponding drawing. Also, even elements that are not denoted by reference numbers may be described with reference to other drawings.

Many different forms and embodiments are possible without deviating from the spirit and teachings of this disclosure and so this disclosure should not be construed as limited to the example embodiments set forth herein. Rather, these example embodiments are provided so that this disclosure will be thorough and complete, and will convey the scope of the disclosure to those skilled in the art.

Reference in this specification to "one embodiment" or "an embodiment" means that a particular feature, structure, or characteristic described in connection with the embodiment is included in at least one embodiment of the present disclosure. The appearance of the phrase "in one embodiment" in various places in the specification are not necessarily all referring to the same embodiment, nor are separate or alternative embodiments mutually exclusive of other embodiments.

Figure 2:
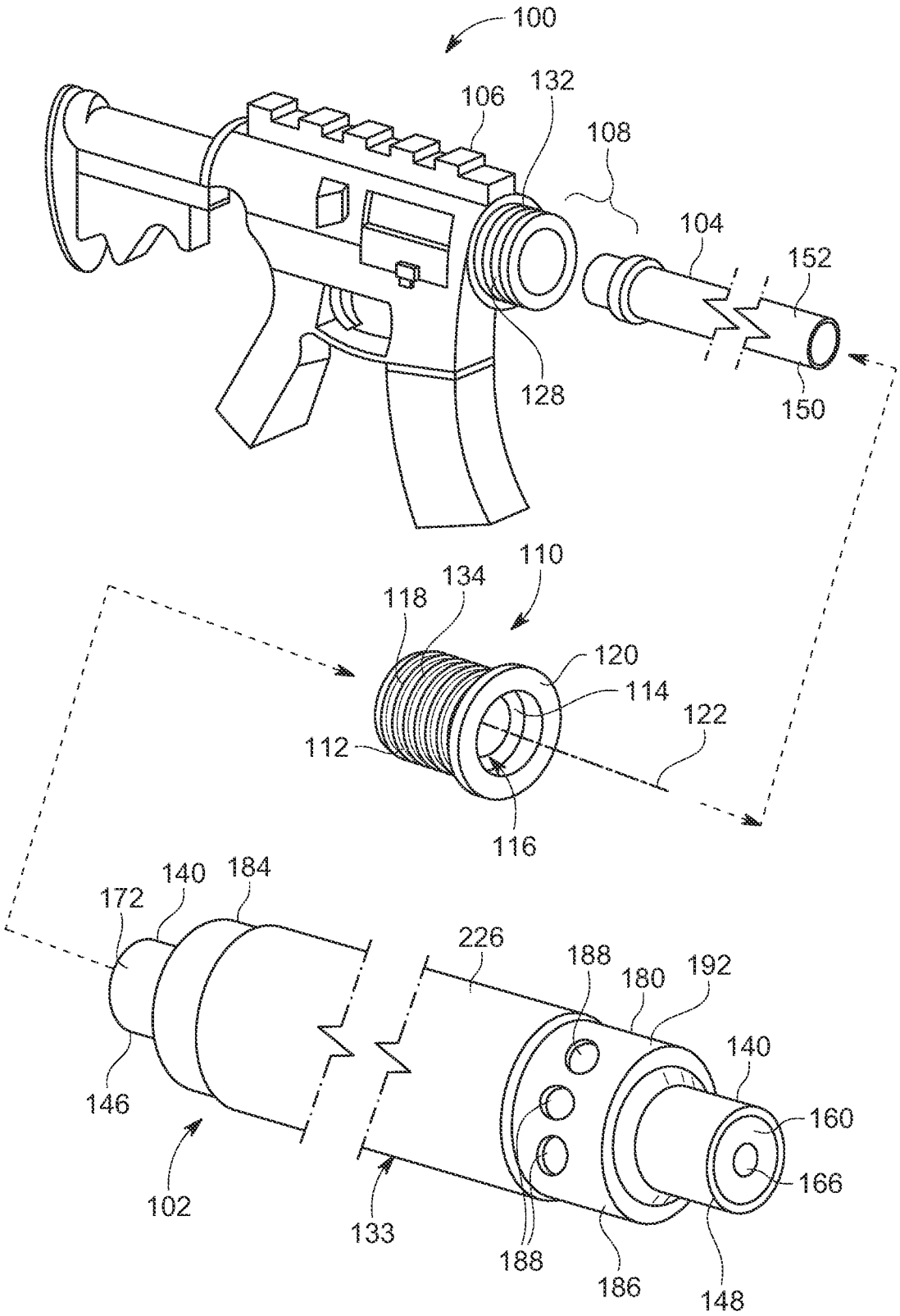
FIG. 2 illustrates an exploded view of the firearm of FIG. 1 depicting an adapter for coupling the suppressor assembly to a receiver of the firearm, in accordance with an embodiment of the disclosure.
Figure 3:
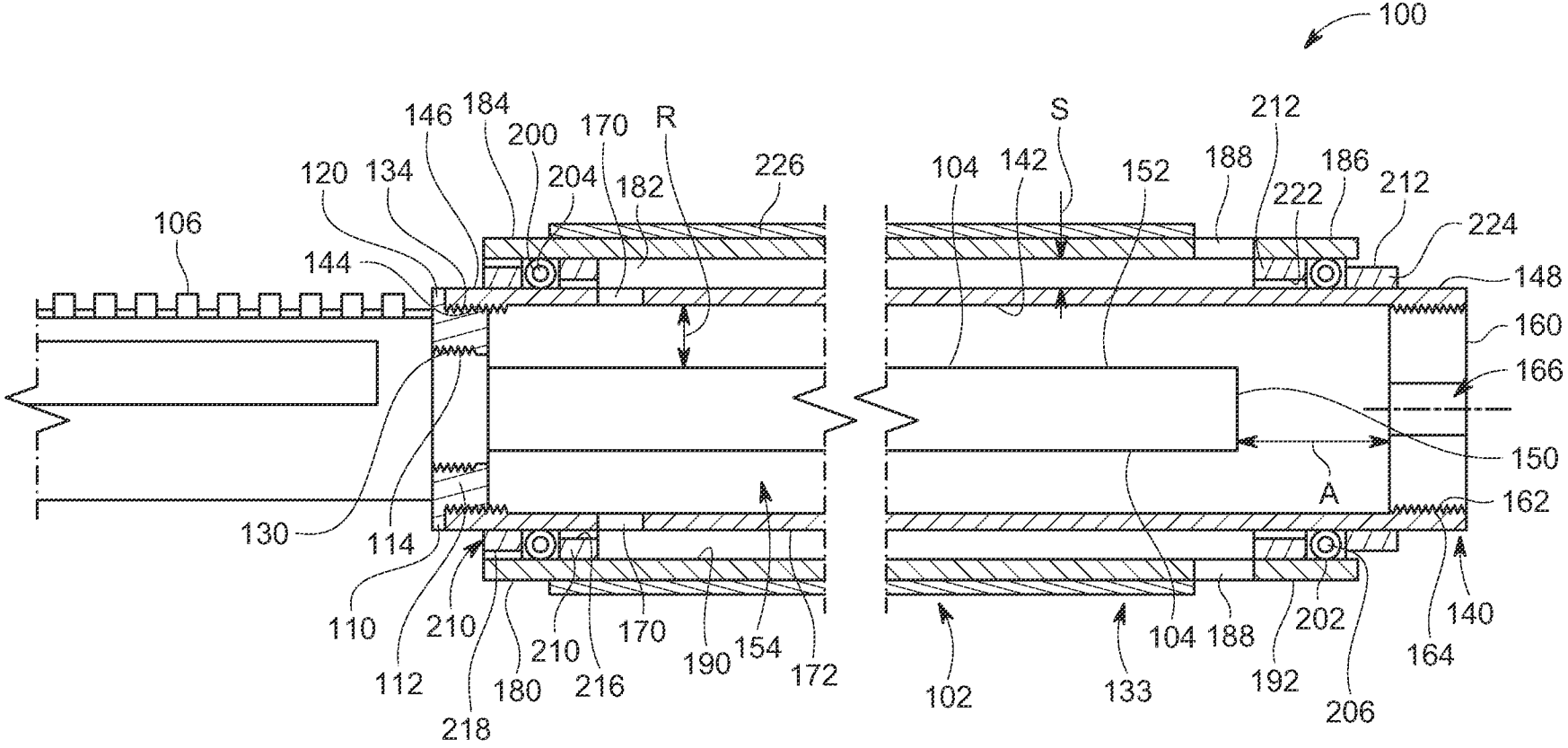
FIG. 3 illustrates a sectional view of a front portion of the firearm of FIG. 1, in accordance with an embodiment of the disclosure.

Referring to FIGS. 1 to 3, a firearm 100 having a suppressor assembly 102 is shown, according to an example embodiment of the disclosure. The firearm 100 is shown as ArmaLite™ Rifle. However, the firearm 100 may be any other gun or rifle known in the art. As shown, the firearm 100 includes a barrel 104 and a receiver 106, with the barrel 104 removably coupled to the receiver 106. As shown, a first end portion of the barrel 104 extends inside the receiver 106 in an assembly of the barrel 104 and the receiver 106 such that the barrel 104 extends outwardly in a longitudinal direction and is cantilevered from the receiver 106. Further, the suppressor assembly 102 is coupled to an end portion of the receiver 106 at a barrel receiver junction 108. The suppressor assembly 102 is positioned over the barrel 104 and is coupled to the receiver 106, and extends in the longitudinal direction, completely encapsulating the barrel 104.

To enable the connection of the suppressor assembly 102 with the barrel 104, the suppressor assembly 102 may include an adapter 110 adapted to be arranged proximate to the barrel receiver junction 108. As shown, the adapter 110 includes a body portion 112 having substantially cylindrical shape with an inner surface 114 defining an elongated cavity 116 and outer surface 118, and a flange portion 120 extending radially outwardly from the outer surface 118 of the body portion 112 and disposed at an end of the adapter 110. As shown, the flange portion 120 is arranged circularly around a central axis 122 of the adapter 110 to limit engagement of the suppressor 102. In some alternative embodiments, the flange portion 120 or the body portion 112 may define at least one passage extending in an axial direction (not shown) to communicate with a gas operating system of the firearm 100.

In an assembly of the adapter 110 with the receiver 106, as shown in FIG. 3, a portion of the receiver 106 extends inside the body portion 112 (i.e., the cavity 116) and the inner surface 114 of the body portion 112 is engaged/coupled to an outer surface 128 of the receiver 106. Further, in an assembly of the adapter 110 with the receiver 106, the flange portion 120 is arranged in abutment with a step of the receiver 106. In the illustrated embodiment, the inner surface 114 defines internal threads 130 (shown in FIG. 3) that engage with external threads 132 define by the outer surface 128 of the receiver 106. Although the threaded engagement of the adapter 110 and the receiver 106 is shown and contemplated, it may be appreciated that the adapter 110 may be engaged/mounted on the receiver 106 by any other coupling means, such as, but not limited to, press fitting, welding, fasteners, or any other similar method known in the art. In some embodiments, the adapter 110 is integrally formed with the receiver 106.

The adapter 110 facilitates the coupling/engagement of a suppressor 133 of the suppressor assembly 102 with the receiver 106. For so doing, the outer surface 118 of the body portion 112 defines external threads 134. As best shown in FIG. 3, the suppressor 133 includes a tube 140 or a first tube 140 (hereinafter referred to as inner tube 140) having a length greater than a length of the barrel 104, and internal dimensions greater than an outer diameter of the barrel 104. It may be appreciated that the internal dimensions of the inner tube 140 is substantially equal to an outer dimensions of the body portion 112 of the adapter 110 to enable the engagement/coupling or mounting of the inner tube 140 to the adapter 110. To facilitate a coupling of the inner tube 140 to the adapter 110, an inner surface 142 of the inner tube 140 defines a first internal threaded portion 144 arranged at a first end 146 of the inner tube 140. The first internal threaded portion 144 engages with the external threads 134 of the body portion 112 (i.e., adapter 110). Although a threaded engagement of the inner tube 140 with the adapter 110 is contemplated, it may be appreciated that the inner tube 140 may be press fitted, welded, fastened using fasteners, or adhesively bonded to the body portion 112 of the adapter 110. In some embodiments, the adapter 110 is integral to the inner tube 140

As shown in FIG. 3, the inner tube 140 extends outwardly of the adapter in a longitudinal/axial direction and includes a second end 148 that is arranged outwardly and away from a muzzle end 150 of the barrel 104. Accordingly, the inner tube 140 is cantilevered on the adapter 110 and is configured to be arranged around the barrel 104 and completely encapsulating the barrel 104. As the inner dimensions of the inner tube 140 are greater than the outer diameter of the barrel 104, a radial gap 'R' is defined between the inner surface 142 of the inner tube 140 and an outer surface 152 of the barrel 104. Also, an axial gap 'A' is defined between the second end 148 of the inner tube 140 and the muzzle end 150 of the barrel 104 as the inner tube 140 extends outwardly of the muzzle end 150 in the longitudinal/axial direction of the firearm 100. The axial gap 'A' and the radial gap 'R" together define an expansion volume 154 between the inner tube 140 and the barrel 104 to enable an expansion of propellant gases discharged during a firing of the bullet from the firearm 100.

The internal dimensions and the length of the inner tube 140 defines a volume ratio (i.e., first volume ratio) between the expansion volume 154 and an inner volume of the barrel. It may be appreciated to those skilled in the art that the larger the volume ratio, the lower the propellant gas pressure inside the inner tube 140, and hence the suppressor 133, and the lower noise generation when the firearm 100 is fired. Moreover, in some embodiments, the inner tube 140 may be comprised of a structurally rigid, high strength material such as alloy steel 4130 or aluminum 7075. However, the inner tube 140 may be made of any other suitable material, such as, but not limited to, aluminum, cast steel, metal, alloy, or any other suitable material known in the art. In the illustrated embodiment, the inner tube 140 may be configured in a circular shape. However, the inner tube 140 may take any suitable shape, such as triangular, square, hexagonal, or any regular or irregular polygon know in the art.

Further, the suppressor assembly 102 includes an end cap 160 (best shown in FIG. 3) to close an axial opening of the inner tube 140, and therefore seals the expansion volume 154, and hence the second end 148 of the inner tube 140. To facilitate the engagement of the end cap 160 with the inner tube 140, the inner surface 142 of the inner tube 140 defines a second internal threaded portion 162 arranged at the second end 148 of the inner tube 140, and the end cap 160 defines external threads 164. In the assembly of the end cap 160 with the inner tube 140, the end cap 160 is disposed at the second end 148 of the inner tube 140 and is arranged inside the inner tube 140 with external threads 164 of the end cap 160 engaged with the second internal threaded portion 162 of the inner tube 140. Although the threaded engagement of the end cap 160 and the inner tube 140 is shown and contemplated, it may be envisioned that the end cap 160 may press fitted, welded, adhesively bonded, or fastened to the inner tube using fasteners. In some embodiments, the end cap 160 may be integrally formed with the inner tube 140. To enable an exit of the bullet from the suppressor assembly 102, the end cap 160 defines an outlet opening 166 extending in the longitudinal/axial direction and arranged coaxial to the barrel 104. It may be appreciated that a diameter of the outlet opening 166 may be substantially equal to an inner diameter of the barrel 104. In an embodiment, the end cap 160 may fabricated from a non-metallic, acoustically dampened material, such as, but not limited to, Nylon 6/6. However, the end cap 160 may be fabricated from any other suitable material available in the art.

Additionally, the inner tube 140 defines at least one port 170 (shown in FIG. 3) extending in the radial direction from the inner surface 142 of the inner tube 140 to an outer surface 172 of the inner tube 140 to enable an exit of the propellant gases from the expansion volume 154. In the illustrated embodiment, the inner tube 140 may defines a plurality of ports 170 arrayed circularly around a central axis of the inner tube 140. As shown, the at least one port 170 is arranged proximate to the first end 146 of the inner tube 140 and may be arranged at location proximate to the adapter 110.

In some embodiments, the suppressor assembly 102 includes a second tube 180 (i.e., outer tube 180) configured to be arranged around the inner tube 140. As shown in FIG. 3, an inner dimensions of the outer tube 180 are greater than an external/outer dimensions of the inner tube 140, thereby a radial space CS' is defined between the inner tube 140 and the outer tube 180. The combination of radial space CS' and the length of the outer tube 180 define annular volume 182, and thus define a volume ratio (i.e., second volume ratio) between the annular volume 182 and the internal volume of the barrel 104. It may be appreciated to those skilled in the art that the larger the sum the first and second volume ratios, the lower the propellant gas pressure inside suppressor 133, and the lower noise generation when the firearm 100 is fired.

As shown, a length of the outer tube 180 is smaller than the length of the inner tube 140, and the outer tube 180 includes a first end 184 arranged proximate to the first end 146 of the inner tube 140, and a second end 186 arranged proximate to the second end 148 of the inner tube 140. As shown, the first end 184 of the outer tube 180 is arranged such that the at least one port 170 opens inside the annular volume 182. Further, the second end 186 is arranged inwardly of the second end 148 of the inner tube 140 in the longitudinal/axial direction. To facilitate an exit of the propellant gases, in an embodiment, shown in FIGS. 1 to 4, the outer tube 180 defines at least one outlet 188 extending in the radial direction from an inner surface 190 of the outer tube 180 to an outer surface 192 of the outer tube 180. The at least one outlet 188 is arranged proximate to the second end 186 of the outer tube 180. In the illustrated embodiment, the outer tube 180 may defines a plurality of outets 188 arrayed circularly around a central axis of the outer tube 180. Accordingly, the propellant gases flow towards the second end 186 of the outer tube 180, upon entry inside the annular volume 182 through the at least one port 170, and exit the annular volume 182 through the at least one outlet 188.

In an embodiment, the outer tube 180 may be made of similar material as that of the inner tube 180, such as a structurally rigid, high strength material such as alloy steel 4130 or aluminum 7075. However, the outer tube 180 may be made of any other suitable material, such as, but not limited to, aluminum, cast steel, metal, alloy, or any other suitable material known in the art. Similarly, the outer tube 180 may also be configured in same shape as the inner tube 140, such as a circular shape. However, the outer tube 180 may take any suitable shape, such as triangular, square, hexagonal, or any regular or irregular polygon know in the art.

Figure 4:
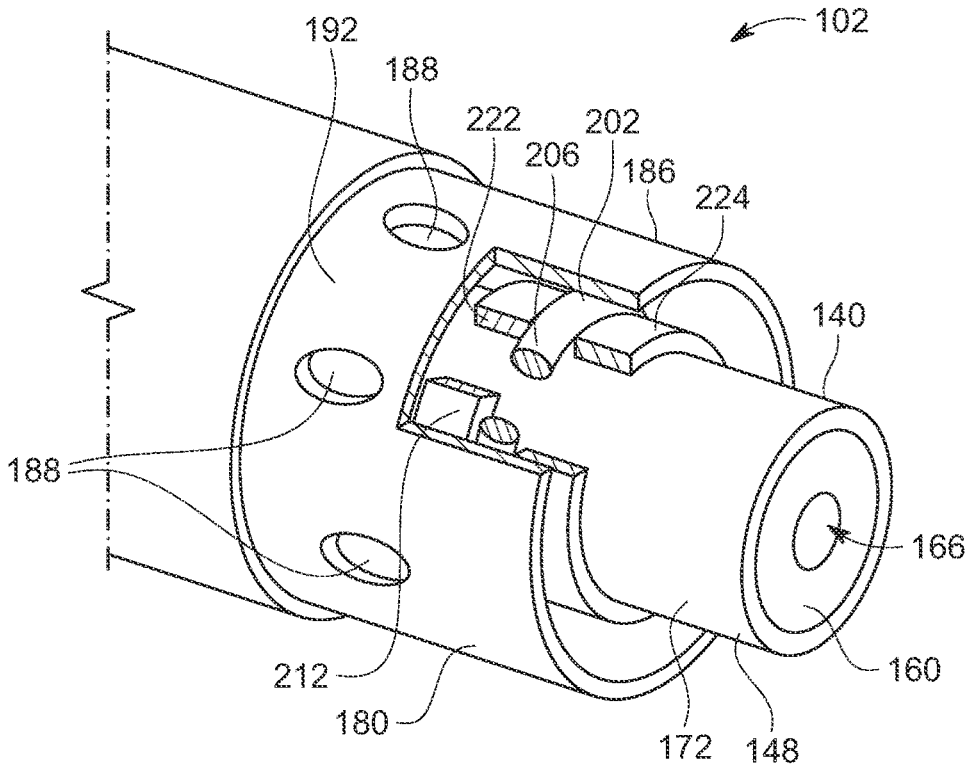
FIG. 4 illustrates a perspective view of a front portion of the suppressor assembly of FIG. 1 with a portion of an outer tube removed and depicting an end plug and a stopper structure, in accordance with an embodiment of the disclosure.

Further, to seal the end openings, defined between the inner tube 140 and the outer tube 180, of the annular volume 182, the suppressor assembly 102 may include a pair of end plugs 200, 202. As shown in FIGS. 3 and 4, the end plugs 200, 202 may be end seals, for example, O-rings 204, 206, arranged proximate to the first end 184 and the second end 186 of the outer tube 180 and extending between the inner tube 140 and the outer tube 180. In some embodiments, the end plugs 200, 202 may be a commercially available Viton® 75 durometer "O" rings or "X" rings. To retain the O-rings 204, 206 at respective positions, the suppressor assembly 102 includes at least one stopper structure, for example, a first stopper structure 210 arranged proximate to the first end 184 of the outer tube 180 and a second stopper structure 212 disposed proximate to the second end 186 of the outer tube 180.

As shown in FIGS. 3 and 4, the first stopper structure 210 includes a first protrusion 216 extending radially inwardly from the inner surface 190 of the outer tube 180 and arranged circularly around the central axis of the outer tube 180, and a second protrusion 218 extending radially outwardly of the outer surface 172 of the inner tube 140 and arranged circularly around the central axis of the inner tube 140. One of the O-rings, for example, a first O-ring 204 (i.e., first end plug 200), is arranged between the first protrusion 216 and the second protrusion 218 in the longitudinal direction. It may be appreciated that a free end of the first protrusion 216 may abut the outer surface 172 of the inner tube 140, while a free end of the second protrusion 218 may abut the inner surface 190 of the outer tube 180. Similarly, the second stopper structure 212 includes a third protrusion 222 extending radially inwardly from the inner surface 190 of the outer tube 180, and a fourth protrusion 224 extending radially outwardly from the outer surface 172 of the inner tube 140. A second O-ring 206 (i.e., the second end plug 202) is arranged between the third protrusion 222 and the fourth protrusion 224 in the longitudinal direction. Although, each of the stopper structures 210, 212 is contemplated to include two protrusions, it may be envisioned that each of stopper structures 210, 212 may include a single protrusion and in such a case, the protrusion may define a seat or groove for the associated O-ring. The stopper structures 210, 212 prevent the disengagement of the O-rings from the inner tube 140 and the outer tube 180.

Additionally, the suppressor assembly 102 may include a damping layer 226 (shown in FIGS. 1 to 4) of sound absorbing material arranged abutting the outer surface 192 of the outer tube 180 to reduce a ringing of the outer tube 180.

Figure 5:
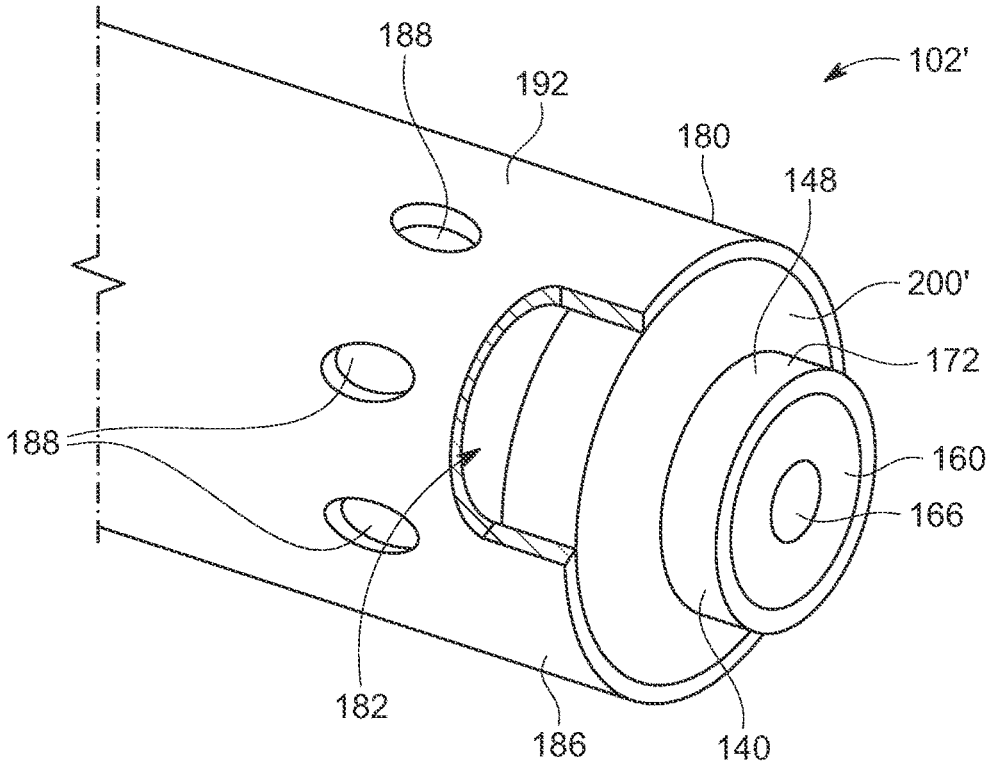
FIG. 5 illustrates a perspective view of a front portion of a suppressor assembly with a portion of the outer tube removed and depicting an end plug, in accordance with an alternative embodiment of the disclosure.

Referring to FIG. 5, a portion of the suppressor assembly 102' according to an alternative embodiment is shown. The suppressor assembly 102' is similar to the suppressor assembly 102 except that the suppressor assembly 102' includes a pair of end plugs 200' that are different from the end plugs 200, 202 of the suppressor assembly 102. Also, the stopper structures 210, 212 are omitted from the suppressor assembly 102'. Similar to the first end plug 200, a first end plug (not shown) of the pair of end plugs 200' is arranged at the first end 184 of the outer tube 180 and extends from the inner surface 190 of the outer tube 180 to the outer surface 172 of the inner tube 140. Similarly, a second end plug 200' of the pair of end plugs 200' is arranged at second end 186 of the outer tube 180 and extends from the inner surface 190 of the outer tube 180 to the outer surface 172 of the inner tube 140. In an embodiment, the end plugs 200' may be press fitted between the inner tube 140 and the outer tube 180. In some embodiments, the end plugs 200' may be integrally formed with either the inner tube 140 or the outer tube 180. The end plugs 200' may be cast in seals. The end plugs 200' may be commercially available cast-in-place elastomer like FIBREGLAST Urethane Casting Resin.

Figure 6:
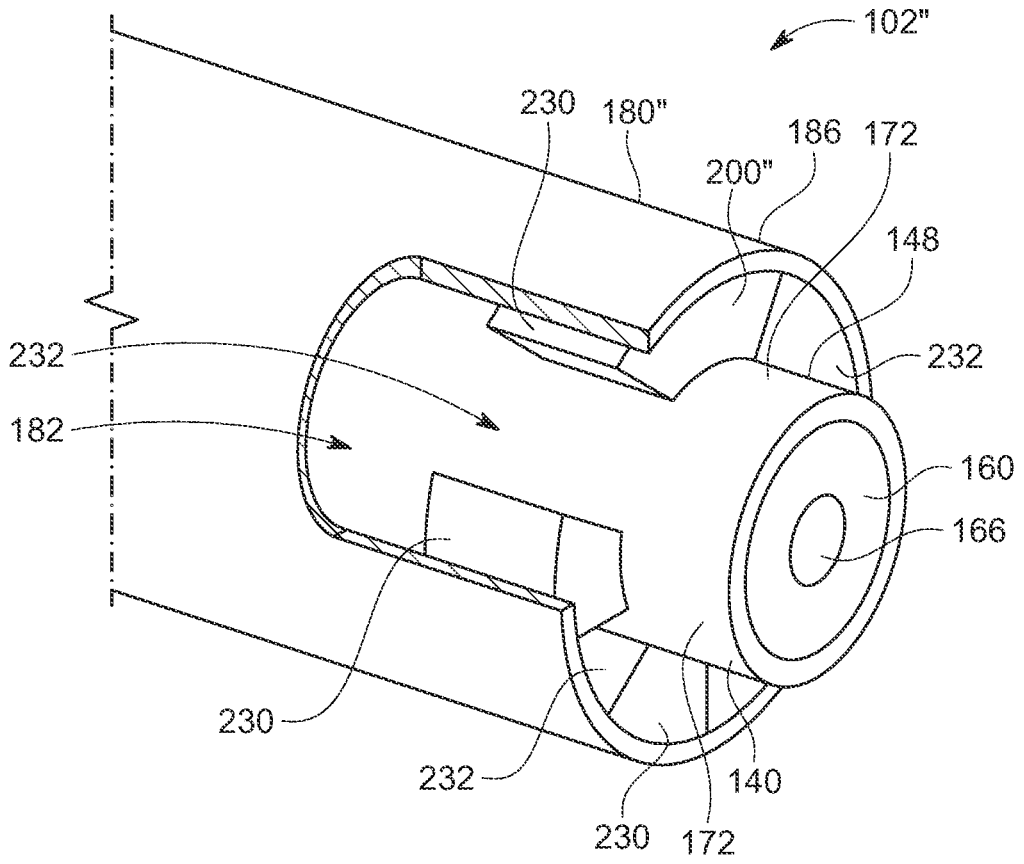
FIG. 6 illustrates a perspective view of a front portion of a suppressor assembly with a portion of an outer tube removed and depicting an end plug defining a plurality of exit ports, in accordance with an alternative embodiment of the disclosure.

Referring to FIG. 6, a portion of the suppressor assembly 102" according to an alternative embodiment is shown. The suppressor assembly 102" is similar to the suppressor assembly 102' except that the suppressor assembly 102" includes a pair of end plugs 200" that is different from the end plugs 200' of the suppressor assembly 102'. Also, the suppressor assembly 102" includes an outer tube 180" that is identical to the outer tube 180 except that the outlets 188 are omitted from the outer tube 180". Similar to the end plugs 200', the end plugs 200" are arranged between the inner surface 190 of the outer tube 180" and the outer surface 172 of the inner tube 140. In some embodiments, the end plugs 200' may be integrally formed with either the inner tube 140 or the outer tube 180. The end plugs 200" may be cast in seals. As shown, each of the end plugs 200" includes a plurality of blocks 230 arrayed circularly around the central axis of the inner tube 140 and the outer tube 180", and arranged spaced apart from each other, thereby defining a plurality of exit ports 232 extending in the longitudinal/axial direction to enable an exit of the propellant gases from the annular volume 182. As shown, the plurality of exit ports 232 are arranged circularly around the central axis of the outer tube 180".

Figure 7:
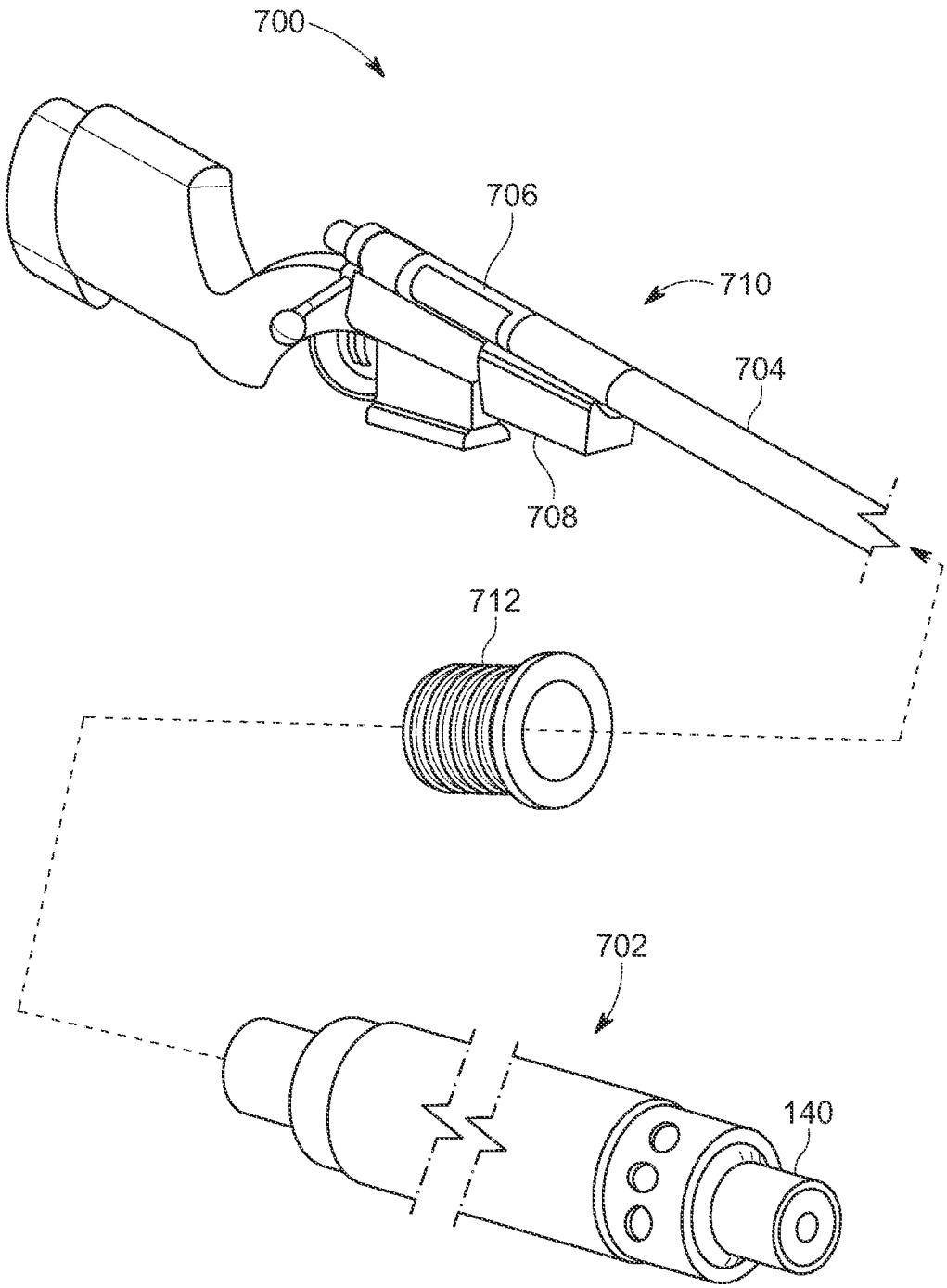
FIG. 7 illustrates an exploded view of an alternative firearm having the suppressor assembly of FIG. 1, in accordance with an embodiment of the disclosure.

Referring to FIG. 7, illustrates a firearm 700 according to an alternative embodiment, the firearm 700 is similar to the firearm 100 except that a receiver 706 and a barrel 704 of a Remington Model 700 Rifle 710, with a shortened forearm 708. A suppressor assembly 702 of the firearm is similar to the suppressor assembly 102 of the firearm except that an adapter 712 of the suppressor assembly 702 is configured to fit on the barrel 704 of Remington Model 700 Rifle 710.

Figure 8:
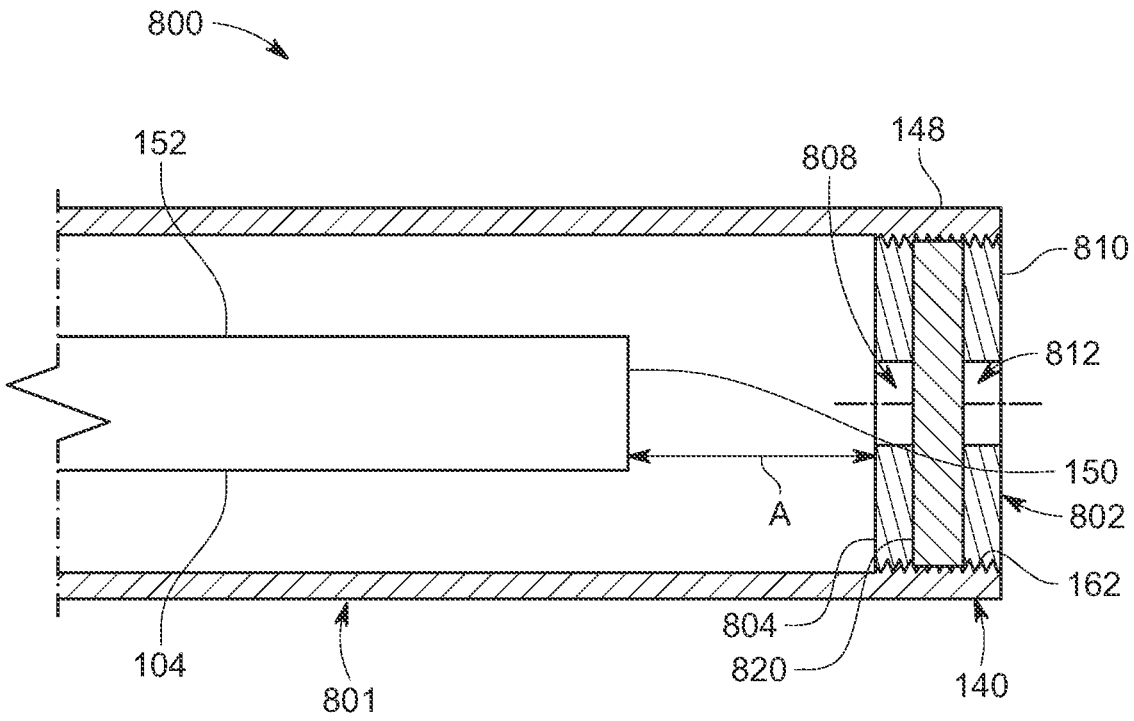
FIG. 8 illustrates a portion of an alternative firearm depicting a portion of an alternate suppressor assembly, in accordance with an embodiment of the disclosure.

Referring to FIG. 8, a portion of a firearm 800 according to another embodiment is shown. The firearm 800 is similar to the firearm 100 except that a suppressor assembly 801 of the firearm 800 includes an end cap assembly 802 instead of the end cap 160. The end cap assembly 802 is arranged at the second end 148 of the inner tube 140 to close an axial opening of the inner tube 140, and includes a stopper 804 arranged in threaded engagement with the second internal threaded portion 162 of the inner tube 140. The stopper 804 includes an outlet opening 808 to enable a passage of the bullet fired from the barrel 104. Further, the end cap assembly 802 includes a retainer 810 arranged coaxially to the stopper 804 and the inner tube 140, and disposed in threaded engagement with the second internal threaded portion 162 of the inner tube 140. The retainer 810 includes an outlet 812 disposed coaxially to the outlet opening 808 of the stopper 804 to facilitate an exit of the bullet. As shown, the retainer 810 is disposed distally to the barrel 104 relative to the stopper 804 in the longitudinal direction. Moreover, the end cap assembly 802 includes a closure layer 820 sandwiched between the stopper 804 and the retainer 810. Retainer 810 prevents dislodgment of the closure layer 820 from the second end 148 of the inner tube 140. When the firearm 800 is fired, the bullet penetrates closure layer 820 making a bullet hole. As can be appreciated by those skilled in the art, the use of closure layer 820 results in an embodiment wherein the trajectory of the bullet, being coaxial with the centerline of the barrel, need not be coaxial with the centerline of the suppressor. Misalignment between the barrel and suppressor axes due to artifacts of tolerances required for manufacture results in a bullet hole in closure layer 820 which may be off center from the centerline of the suppressor assembly 801. The closure layer 820 is comprised of a material with properties to facilitate passage of the bullet, such as, but not limited to, silicone rubber. In an alternate embodiment, the configuration and material of end cap assembly 802 is such that it comprises a monolithic structure combining all features of end cap assembly 802 discussed above.

An embodiment of the invention is as follows and captures all of the suppressor improvements aforementioned: For an AR series of firearm using the NATO 5.56×45 mm Round with a 16 inch barrel and attached flash suppressor the following description is provided. The inner tube 140 is a 2 inch outside diameter cylindrical tube with a 0.125 inches thick wall, 22 inches long and made from aluminum 6061. The outer tube 180 includes a 2.5 inch outside diameter cylindrical tube with a 0.049 inches thick wall, 18 inches long and made from aluminum 6061. Peak pressure and temperature within the suppressor are estimated to be 120 psi and 1500° F. by software developed by the inventor, and thus the exit noise may be as low as 130 dB.

Many modifications and other embodiments of the disclosures set forth herein will come to mind to one skilled in the art to which these disclosures pertain having the benefit of the teachings presented in the foregoing descriptions and the associated drawings. Therefore, it is to be understood that the disclosures are not to be limited to the specific embodiments disclosed and that modifications and other embodiments are intended to be included within the scope of the appended claims. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the appended claims.

LIST OF ELEMENTS

100 firearm
102 suppressor assembly
102' suppressor assembly
102" suppressor assembly
104 barrel
106 receiver
108 barrel receiver junction
110 adapter
112 body portion
114 inner surface
116 elongated cavity
118 outer surface
120 flange portion
122 central axis
124 passage
126 filler
128 outer surface
130 internal threads
132 external threads
133 suppressor
134 external threads
140 inner tube
142 inner surface
144 first internal threaded portion
146 first end
148 second end
150 muzzle end
152 outer surface
154 expansion volume
160 end cap
162 second internal threaded portion
164 external threads
166 outlet opening
170 port
172 outer surface
180 outer tube
180" outer tube
182 annular volume
184 first end
186 second end
188 outlet
190 inner surface
192 outer surface
200 first end plug
200' end plug
200" end plug
202 second end plug
204 first O-ring
206 second O-ring
210 first support structure
212 second support structure
216 first protrusion
218 second protrusion
222 third protrusion
224 fourth protrusion
226 damping layer
230 block
232 exit port
700 firearm
702 suppressor assembly
704 barrel
706 receiver
708 shortened forearm
710 Remington Model 700 Rifle
712 adapter
800 firearm
801 suppressor assembly
802 end cap assembly
804 stopper
808 outlet opening
810 retainer
812 outlet
820 closure layer
'R' radial gap
'A' axial gap
'S' radial space

What is claimed is:

1. A suppressor assembly for a firearm having a receiver and a barrel connected to the receiver, the suppressor assembly comprising:

a tube having a first end adapted to be coupled to the receiver and defining at least one port arranged proximate to the first end and extending in a radial direction, wherein the tube is configured to be arranged around the barrel defining a radial gap therebetween, wherein the tube is configured to extend outwardly of the barrel in a longitudinal direction defining an axial gap therebetween, wherein the radial gap and the axial gap together define an expansion volume around the barrel; and an end cap arranged at a second end of the tube and coupled to the tube, wherein the end cap defines an outlet opening adapted to be arranged coaxially to the barrel to facilitate an exit of a bullet from the tube, wherein propellant gases; generated during firing of the bullet exits a muzzle of the barrel, expand inside the expansion volume and exit the tube through the at least one port.

2. The suppressor assembly of claim 1 further including an adapter configured to couple the first end of the tube to the receiver.

3. The suppressor assembly of claim 2, wherein the adapter includes a body portion adapted to be arranged between the receiver and the tube in a radial direction and configured to couple the receiver to the tube, and a flange portion extending radially outwardly of the body portion and adapted to be arranged between the receiver and tube.

4. The suppressor assembly of claim 1, wherein the tube is an inner tube and the suppressor assembly further includes an outer tube configured to be arranged around the inner tube and defining an annular volume therebetween to receive the propellant gases exiting the at least one port of the inner tube.

5. The suppressor assembly of claim 4, wherein the outer tube includes at least one outlet arranged proximate to an end of the outer tube and extending in the radial direction, wherein the at least one outlet facilitates an escape of the propellant gases from the annular volume.

6. The suppressor assembly of claim 4 further including at least one end plug disposed between the inner tube and the outer tube and engaged with the inner tube and the outer tube.

7. The suppressor assembly of claim 6 further including at least one stopper structure arranged between the inner tube and the outer tube to restrict a movement of the at least one end plug in the longitudinal direction.

8. The suppressor assembly of claim 6, wherein the at least one end plug is arranged proximate to the second end of the inner tube, wherein the at least one end plug defines a plurality of exit ports arrayed circularly around a central axis of the at least one end plug and extending in the longitudinal direction.

9. The suppressor assembly of claim 4 further including a damping layer arranged abutting an outer surface of the outer tube, wherein the damping layer includes sound absorbing material.

10. The suppressor assembly of claim 1, wherein the at least one end plug comprises a closure layer such that when the firearm is fired the bullet penetrates said closure layer making a bullet hole.

11. A firearm, comprising:

a receiver;

a barrel coupled to the receiver;

a tube having a first end coupled to the receiver and defining at least one port arranged proximate to the first end and extending in a radial direction, wherein the tube is configured to be arranged around the barrel defining a radial gap therebetween, wherein the tube extends outwardly of the barrel in a longitudinal direction defining an axial gap therebetween, wherein the radial gap and the axial gap together define an expansion volume around the barrel; and an end cap arranged at a second end of the tube and coupled to the tube, wherein the end cap defines an outlet opening arranged coaxially to the barrel to facilitate an exit of a bullet from the tube;

wherein propellant gases; generated during firing of the bullet exits a muzzle of the barrel, expand inside the expansion volume and exit the tube through the at least one port.

12. The firearm of claim 11 further including an adapter coupling the first end of the tube to the receiver, the adapter includes a body portion arranged between the receiver and the tube in a radial direction and coupling the receiver to the tube, and a flange portion extending radially outwardly of the body portion and adapted to be arranged between the receiver and tube in the longitudinal direction.

13. The firearm of claim 11 wherein the tube is an inner tube and the firearm further includes an outer tube configured to be arranged around the inner tube and defining an annular volume therebetween to receive the propellant gases exiting the at least one port defined at the inner tube.

14. The firearm of claim 13, wherein the outer tube includes at least one outlet arranged proximate to an end of the outer tube and extending in the radial direction, wherein the at least one outlet facilitates an escape of the propellant gases from the annular volume.

15. The firearm of claim 13 further including at least one end plug disposed between the inner tube and the outer tube and engaged with the inner tube and the outer tube.

16. The firearm of claim 15 further including at least one stopper structure arranged between the inner tube and the outer tube to restrict a movement of the at least one end plug in the longitudinal direction.

17. The firearm of claim 15, wherein the at least one end plug is arranged proximate to the second end of the inner tube and defines a plurality of exit ports arrayed circularly around a central axis of the first end plug and extending in the longitudinal direction.

18. The suppressor assembly of claim 11, wherein the at least one end plug comprises a closure layer such that when the firearm is fired the bullet penetrates said closure layer making a bullet hole.

19. A suppressor assembly for a firearm having a receiver and a barrel connected to the receiver, the suppressor assembly comprising:

a first tube having a first end adapted to be coupled to the receiver and defining at least one port arranged proximate to the first end and extending in a radial direction, wherein the first tube is configured to be arranged around the barrel defining a radial gap therebetween, wherein the first tube is configured to extend outwardly of the barrel in a longitudinal direction defining an axial gap therebetween, wherein the radial gap and the axial gap together define an expansion volume around the barrel;

an end cap arranged at a second end of the first tube and coupled to the first tube, wherein the end cap defines an outlet opening adapted to be arranged coaxially to the barrel to facilitate an exit of a bullet from the first tube;

a second tube configured to be arranged around the first tube and defining an annular volume therebetween; and at least one end plug disposed between the first tube and the second tube and engaged with the first tube and the second tube, wherein at least one of the second tube defines at least one outlet extending in the radial direction, or the at least one end plug defines a plurality of exit ports arrayed circularly around a central axis of the end plug and extending in the longitudinal direction, wherein propellant gases generated during firing of the bullet exits a muzzle of the barrel, expand inside the expansion volume and enter the annular volume from the expansion volume through the at least one port.

20. The suppressor assembly of claim 19 further including an adapter configured to couple the first end of the tube to the receiver, the adapter includes a body portion adapted to be arranged between the receiver and the tube in the radial direction and configured to couple the tube to the receiver, and a flange portion extending radially outwardly of the body portion and adapted to be arranged between the receiver and tube.

21. The suppressor assembly of claim 19 further including at least one stopper structure arranged between the inner tube and the outer tube to restrict a movement of the at least one end plug in the longitudinal direction.

22. The suppressor assembly of claim 19 further including a damping layer arranged abutting an outer surface of the outer tube, wherein the damping layer includes sound absorbing material.

23. The suppressor assembly of claim 19, wherein the at least one end plug comprises a closure layer such that when the firearm is fired the bullet penetrates said closure layer making a bullet hole.

* * * * *